US008297594B1

(12) United States Patent
Ontiveros

(10) Patent No.: US 8,297,594 B1
(45) Date of Patent: Oct. 30, 2012

(54) UTILITY TOOL FOR USE WITH A MOTOR VEHICLE

(76) Inventor: Steve Ontiveros, Oxnard, CA (US)

( * ) Notice: Subject to any disclaimer, the term of this patent is extended or adjusted under 35 U.S.C. 154(b) by 0 days.

(21) Appl. No.: 13/178,760

(22) Filed: Jul. 8, 2011

Related U.S. Application Data

(63) Continuation-in-part of application No. 12/401,757, filed on Mar. 11, 2009, now abandoned.

(51) Int. Cl.

| | |
|---|---|
| ***B25C 11/00*** | (2006.01) |
| ***B66F 15/00*** | (2006.01) |
| ***B25B 27/14*** | (2006.01) |
| ***B25B 27/00*** | (2006.01) |
| ***B25B 23/16*** | (2006.01) |
| ***B21K 5/00*** | (2006.01) |
| ***B25G 1/00*** | (2006.01) |

(52) U.S. Cl. ..... 254/25; 29/278; 29/242; 29/270; 81/177.1

(58) Field of Classification Search ..... 254/25; 29/278, 242, 243, 270, 3, 6, 402.08, 275, 29/240, 243.56; 81/177.1
See application file for complete search history.

(56) References Cited

U.S. PATENT DOCUMENTS

| | | | | |
|---|---|---|---|---|
| 2,539,849 | A | 1/1951 | Lum | |
| 4,738,126 | A | 4/1988 | Haberle | |
| 4,784,610 | A | 11/1988 | Stuart | |
| 5,191,690 | A * | 3/1993 | Koehn | 29/275 |
| 5,240,311 | A | 8/1993 | Bunker | |
| 5,244,241 | A * | 9/1993 | Lee | 294/50.6 |
| 5,253,406 | A * | 10/1993 | Shere et al. | 29/240 |
| 6,536,118 | B1 | 3/2003 | Campbell | |
| 6,886,229 | B1 | 5/2005 | Wilson | |
| 6,902,176 | B2 * | 6/2005 | Gottschalk | 280/93.512 |
| 6,957,478 | B1 | 10/2005 | Ontiveros | |
| 7,753,342 | B1 * | 7/2010 | Nolle | 254/25 |
| 2005/0210649 | A1 * | 9/2005 | Oliver | 29/402.08 |

* cited by examiner

*Primary Examiner* — Lee D Wilson
*Assistant Examiner* — Alvin Grant
(74) *Attorney, Agent, or Firm* — Richard S. Erbe

(57) ABSTRACT

A tool for disconnecting the air and electrical connections between a motor vehicle and a trailer or a utility hookup station includes a handle and a forked member. The trailer connection includes an electrical socket with pins covered by a hinged cover plate; the motor vehicle connection includes a plug member. The forked member of the tool includes a pair of parallel hooks, one at the end of each of two linear elements of the forked member. A sloped interface portion on the forked member of the tool lifts the hinged cover plate away from the trailer's socket. The forked member is placed around the electrical connection adjacent the plug member and is pushed forward to lift the hinged cover plate. Once the hinged cover plate is lifted, the handle is pushed towards the motor vehicle, where the hooks engage lugs on the plug member, thus causing the plug member to separate from the electrical socket. Gripping grooves on the linear elements help to facilitate engagement between the tool and the lugs. Projections extending from the forked portion of the tool can be used to engage the air line connectors between a motor vehicle and a trailer or a utility hookup station to separate the air lines. A kingpin pulling slot may also be included on the tool.

9 Claims, 5 Drawing Sheets

UTILITY TOOL FOR USE WITH A MOTOR VEHICLE

RELATED APPLICATIONS

This application is a continuation-in-part application of U.S. patent application Ser. No. 12/401,757, filed Mar. 11, 2009 now abandoned.

BACKGROUND OF THE INVENTION

1. Field of the Invention

The present invention relates to tools for use with motor vehicles. More particularly, it relates to a portable tool for use in disconnecting power and air lines between a motor vehicle, such as a truck cab, and a trailer that is towed by the motor vehicle, or some form of utility hookup apparatus.

2. General Background and State of the Art

The economies of our developed industrial nations rely heavily on the transport of goods by trucks and truckers. Many trailers that are towed by a truck, because of the nature of the goods they carry, require both power and air. Truck/trailer combinations actually have two air lines, one for service and one for the parking brake (a safety feature on modern trucks).

During the last several years, travel by recreational vehicle (RV) has become increasingly popular. Nationwide, there are numerous camp grounds that provide space for persons traveling by RV that include hookups for power. That way, when a person or persons wants to camp for the night, they have ready access to necessary power for their comfort. Recently, RV's, especially large ones, have switched to air powered brakes and air assisted electrical and hydraulic brakes on trailers towed by them.

The typical way of hooking up a motor vehicle and trailer for power is to plug a female connector on the end of an electrical cable from the motor into a socket having connector pins that is mounted in the wall of a trailer. The connector pins in the trailer are protected by a hinged plate that covers the pins when the trailer is not hooked to the motor vehicle's electrical system. The hinged cover plate is moved up and away from the socket when the electrical system of the trailer is hooked up to the electrical system of the vehicle.

Electrical wires that connect to the electrical system of the trailer are connected to pins that are mounted on the inside of the trailer wall just behind the electrical socket assembly. These pins are in electrical communication with the pins in the socket assembly.

Air lines between trucks or motor vehicles and trailers are generally joined by locking flanges found mounted on the trailer wall and corresponding locking flanges found on the air lines from the truck. This kind of structure is generally known as "glad hands."

The electrical lines connecting commercial trucks to trailer systems or RV's to campground utility system are usually disengaged from each other by pulling the trailer socket and the vehicle plug portions away from each other by hand. This procedure can be difficult on a person's hands and can easily cause injury. Often, after a lengthy trip, the socket and plug portions can be very dirty and can cause a mess. Some of the dirt and grime collected on the electrical connectors could infiltrate the body through an opening in the skin and cause illness or infection.

Another problem associated with manually separating the trailer electrical socket and plug on a motor vehicle is that the process of pulling the two apart frequently includes "wiggling" of the socket and plug, which may lead to the wires in the trailer being separated from the connector pins. Thus, some of the trailer's lights may not receive electricity or the supply of electricity will be interrupted, causing the trailer lights to blink or become inoperable. This result can lead to traffic citations being handed out to truckers as they carry out their work. It may also lead to a potentially dangerous situation on the road under conditions of low visibility, such as in heavy rain, snow, or dense fog.

The inventor knows of only two attempts to devise a way to disconnect the electrical connectors between a commercial truck cab and a trailer that differs from the manual procedure. U.S. Pat. No. 4,784,610 discloses a tool permanently attached to the electrical connection socket of a trailer. To disconnect the truck electrical line from the electrical system of the trailer, a person grasps the tool by its handle and by applying leverage against the plug can pull the handle away from the trailer causing the plug and socket to separate. The tool disclosed in Stuart is permanently attached to the trailer and cannot be stored in the truck cab, nor can the tool be used to separate the air lines between the truck cab and the trailer. Furthermore, it cannot be adapted for use on all models of trailer.

Co-owned U.S. Pat. No. 6,957,478 (the '478 patent) discloses a portable tool that could be used for the purpose of separating the utility lines between a trailer and a motor vehicle. The tool in the '478 patent incorporated a spring mounted push bar for leverage and a lifting bar to raise the hinged cover of the trailer's electrical socket assembly. Pushing the curved handle of the tool towards the electrical socket will cause the plug and socket to separate, without the possibility of the electrical wiring in the trailer becoming disconnected.

The present invention provides a novel tool that includes many of the advantages of the invention disclosed in the '478 patent and includes other advantageous aspects not known in the prior art.

SUMMARY OF THE INVENTION

Accordingly, it is an object of the invention to provide a tool for use with a large motor vehicle that can be used to separate electrical lines between the motor vehicle and another item.

An additional object of the invention is to provide a tool for use with a large motor vehicle that can be used to separate air utility lines between the motor vehicle and another item.

A further object of the invention is to provide a tool for use with a large motor vehicle that is easy to use and store.

Yet another object of the invention is to provide a tool for use with a large motor vehicle that is portable.

Still another object of the invention is to provide a tool for use with a large motor vehicle that can be used with any model of motor vehicle or trailer, regardless of the manufacturer.

It is yet another object of the invention to provide a tool for use with a large motor vehicle that protects the electrical connectors of a commercial truck trailer from damage.

Another object of the invention is to provide a tool for use with a large motor vehicle that protects the hands of the user from injury and dirt.

A further object of the invention is to provide a fool for use with a large motor vehicle that provides more secure gripping of the electrical and air connections on a motor vehicle.

Still a further object of the invention is to provide a tool for use with a large motor vehicle that provides the user with the ability to disconnect a truck cab from a trailer.

These and other objectives are achieved by the present invention, which, in a broad aspect, provides the user with a hand tool that can be stored in the cabin of a truck cab or other motor vehicle and be carried to the back of the vehicle to disengage the electrical and/or air systems between the truck cab and a trailer or between an RV and the utility hookups found in campgrounds.

The tool of the present invention includes a handle portion connected to a generally U-shaped or forked member at one end of the handle. The forked member includes a pair of linear elements extending away from the point where the handle portion joins the forked member. Each of the linear elements ends with a hook that provides leverage when separating the electrical lines between a vehicle and a trailer or an RV and the utility hookups. The hooks are preferably disposed parallel to each other. The linear elements may also each include a gripping groove.

A sloped interface portion disposed on the forked member is used to enable lifting of the hinged cover away from the trailer's electrical socket when the tool is in use. The sloped interface portion is constructed so that the tool may be adapted for use with any commercially made truck or RV.

When a user, for example, wishes to disconnect the electrical connection between a truck cab and a trailer, the user grasps the handle portion on one end and pushes the forked member down and around the electrical connection on the truck cab and pushes the tool towards the electrical socket assembly on the trailer. The pushing motion causes the sloped interface portion to push the hinged cover on the trailer electrical connector up and away from the juncture of the trailer electrical socket and the truck electrical plug member. Once the tool is in this position, the trucker continues to push the tool towards the electrical socket while rotating the handle towards the trailer so that either the hooks or the gripping grooves on each of the linear elements engage the lugs on either side of the plug member and cause the plug member to move horizontally away from the trailer electrical socket assembly. Whether the hooks or the gripping grooves interface with the lugs depends of the particular design of the electrical connectors, and this feature adds to the versatility of the tool of the present invention. This operation does not require the electrical lines to be manipulated in a manner that will cause the electrical wires and connecting pins in the trailer electrical system to break loose. Lugs of this type may have a sloping configuration; the gripping grooves may include a sloped portion to provide a better engagement of the tool and the lugs.

The tool of the present invention may also be used to separate the two air lines that connect a truck cab's air system to a trailer's air system by the incorporation of a pair of generally parallel projections extending from one of the linear elements of the forked portion of the tool. The projections are configured to engage the connecting elements of the air systems, commonly known as "glad hands." The projections engage the air connector on the trailer and are rotated to simulate the motion of a wrench. This operation causes the connecting elements to disengage from each other, thus enabling the user to separate the two air systems. One or both of the projections may also include a locking groove to provide a more secure engagement between the tool and the air connection elements.

The tool according to the present invention may also include a slot for engaging a kingpin extending from the trailer and allowing the user of the tool to pull on the kingpin to allow for disconnection of the trailer and cab.

The tool of the present invention may also be used in conjunction with a recreational vehicle. Recreational vehicles can be hooked up to utilities in many campgrounds, and the tool of the present invention can be used to disengage the utility systems of the recreational vehicle from the utility hookups provided by the campground owners.

The tool of the present invention also includes a gripping portion to aid in its effective operation. While the tool may have a variety of constructions, it will preferably be a cast metal construction.

Further objects and advantages of this invention will become more apparent from the following description of the preferred embodiment, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiment of the invention with reference to the drawings in which.

DETAILED DESCRIPTION OF THE PREFERRED EMBODIMENT OF THE INVENTION

Figure 1:
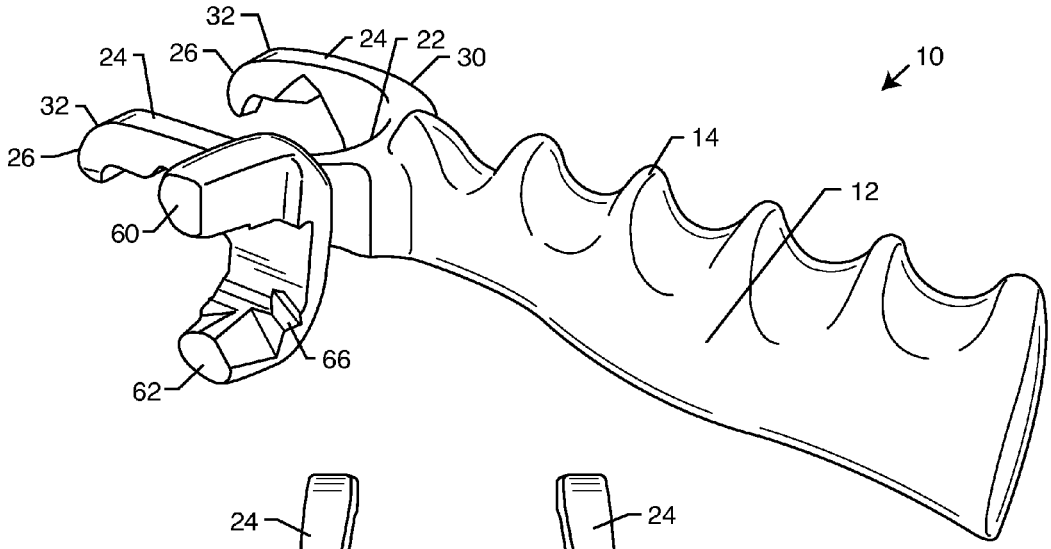
FIG. 1 illustrates a perspective view of an exemplary tool according to the present invention.

In the following description of the invention, reference is made to the accompanying drawings, which form a part thereof, and in which are shown, by way of illustration, an exemplary embodiment illustrating the principles of the present invention and how it may be practiced. It is to be understood that other embodiments may be utilized to practice the present invention, and structural and functional changes may be made thereto without departing from the scope of the present invention.

An exemplary embodiment of a tool according to the present invention is illustrated in FIGS. 1-5 and is generally referred to by the reference numeral 10. The tool is preferably constructed of metal and is designed to be portable and durable. Tool 10 includes a handle 12 and a gripping portion 14.

Attached to handle 12 is a forked member 20, which includes curved element 22 and a pair of linear elements 24 and is generally in the shape of a "U". Each linear element 24 includes a proximal end 30, where it connects to curved element 22, and a distal end 32, at which is mounted a hook 26, whose function will be described later. Those having skill in the art will understand that forked member 20, curved element 22, linear elements 24 and hooks 26 may be constructed as a single piece. Hooks 26 are configured so that they are parallel to each other.

Each of said linear elements 24 may also each include a gripping groove 34, which may be required to engage components of some configurations of electrical connectors. The inclusion of gripping grooves 34 provides the ability to use tool 10 with a wide variety of configurations of electrical connectors. Each gripping groove 34 may also include a sloped portion 36 to provide more secure engagement with sloping components frequently found on electrical connectors.

Located on curved element 22 is a sloped interface portion 28, which provides a sliding interface between the tool and the electrical connectors on a motor vehicle, as will be described.

Another feature of tool 10 is a pair of projections 60 and 62 extending perpendicularly from one of the linear elements 24. In the preferred embodiment of the invention, there is illustrated first projection 60 and second projection 62, but it is possible to include a different number of projections without departing from the scope of the invention. The purpose of projections 60 and 62 will be discussed later.

Figure 6:
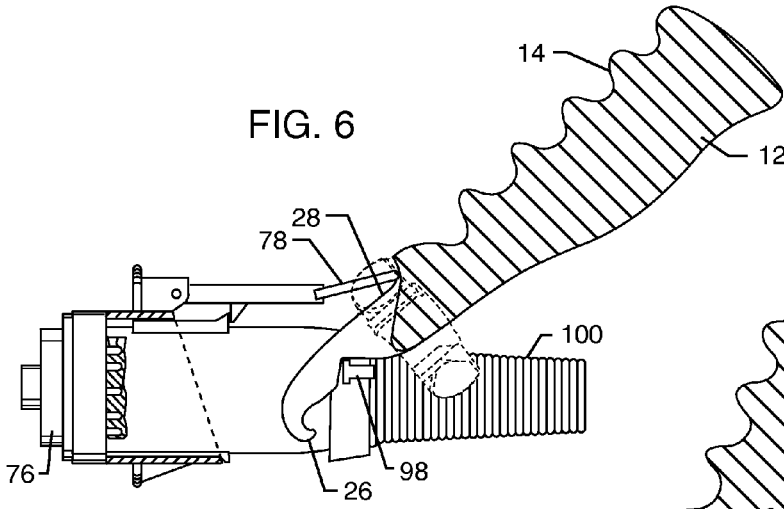
FIGS. 6-8 illustrate how an exemplary tool according to the present invention may be used to separate the electrical connection between a truck cab and a trailer.
Figure 7:
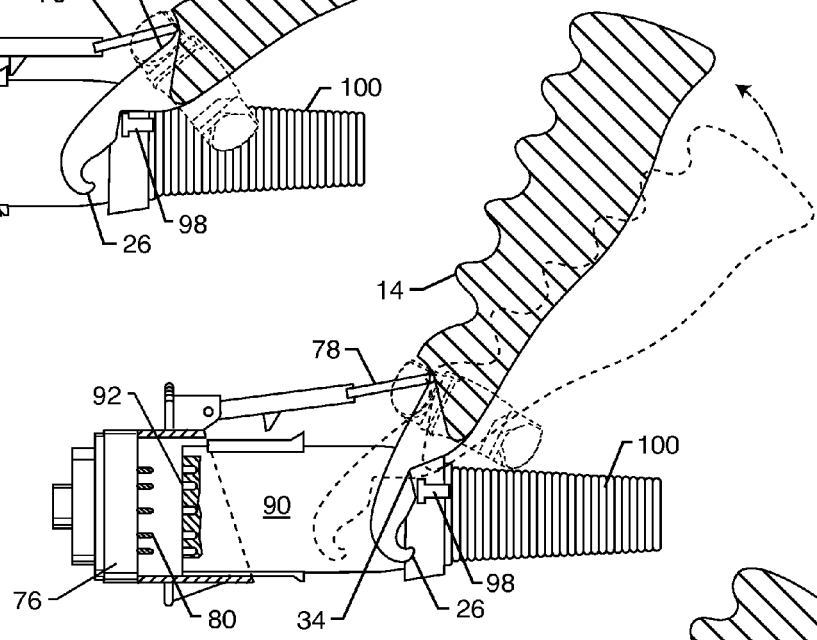
Figure 8:
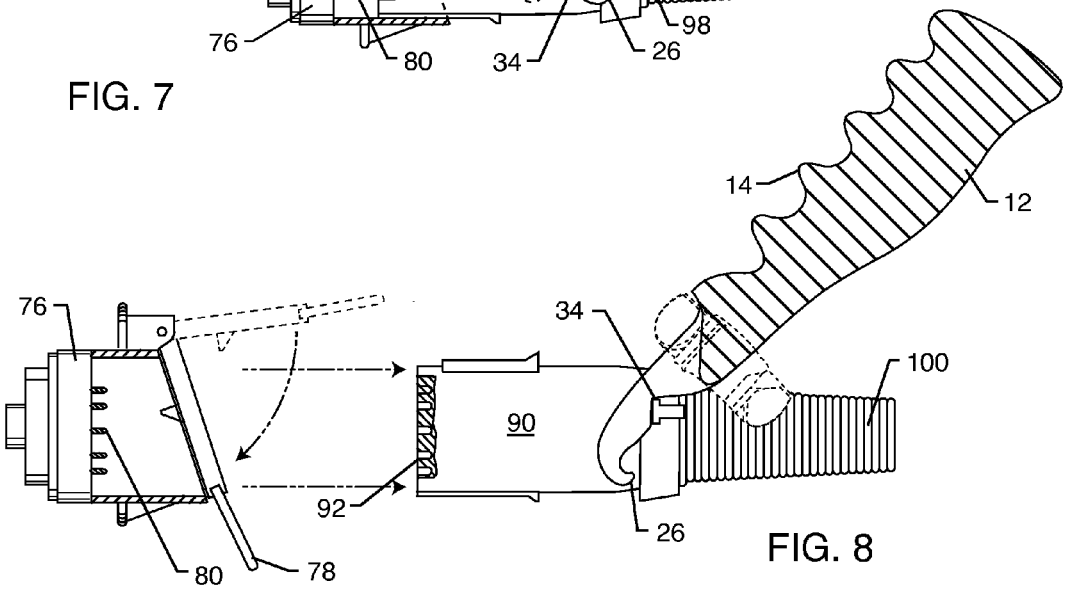

FIGS. 6-8 illustrate how tool 10 can be used to separate the electrical connectors between a truck cab and a trailer. The electrical connectors on all trucks and cabs are not identical, but tool 10 may be used with a large variety of configurations. In this example, an electrical socket assembly 76 mounted on the outside wall of a trailer is connected to a plug member 90 at the end of cable 100 extending from a truck cab.

To separate plug member 90 from socket assembly 76, forked member 20 of tool 10 is positioned so that it straddles axial body 94 of plug member 90, with parallel hooks 26 facing downward. As tool 10 is moved closer to socket assembly 76, sloped interface portion 28 provides a sliding engagement between tool 10 and hinge cover 78 lifting hinged cover 78 to enhance the ability of tool 10 to separate the two connectors. Interface portion 28 is configured to allow tool 10 to continue to be moved while the electrical connectors are being disconnected.

With certain configurations of electrical connections, handle 12 is then pushed towards socket assembly 76, which then causes hooks 26 on linear elements 24 to engage lugs 98 on plug member 90. The user then begins to rotate handle 12 towards socket assembly 12, while continuing to push tool 10 downward. On other configurations of electrical connectors, the movement of tool 10 and engagement of hinge cover 78 by interface portion 28 may require the engagement of gripping grooves 34 on lugs 98; whether hooks 26 or gripping grooves 34 engage the lugs 98 largely depends on the particular configuration of electrical connectors, which varies by manufacturer.

As previously discussed, in the preferred embodiment of the invention, each linear element may include a gripping groove 34. With some configurations of electrical connectors, as the user continues to push handle 12 towards socket assembly 76, gripping grooves 34 engage lugs 98 and apply pressure against them. This action causes plug member 90 to move away from socket assembly 76, thus causing connector pins 80 in socket assembly 76 to separate from female connector 92 of plug member 90. In some electrical connectors, lugs 98 are of a sloping or angled configuration, so each gripping groove 34 may include a sloped portion 36 to provide a better engagement between tool 10 and lugs 98.

FIGS. 9-14 illustrate how tool 10 may be used to disconnect the air lines between a truck cab and a trailer. Tool 10 includes a pair of projections 60 and 62 extending in a generally perpendicular direction from one of the linear elements 24 for assisting in the disconnect procedure. First projection 60 and second projection 62 may be tapered to allow tool 10 to be used with a wide variety of trucks and trailers produced by different manufacturers.

Most commercial trucks and trailers use what is known as "glad hands" to connect their air lines. In FIGS. 9-14, an air socket 110 from a trailer is connected to an air line 120 from a truck. First projection 60 and second projection 62 are placed against flanges 112 and 122 and tool 10 is turned in the manner shown to disengage air socket 110 from air line 120. In the preferred embodiment of the invention, first projection 60 is longer than second projection 62 and includes a locking groove 64 to provide a more secure interface between tool 10 and flanges 112 and 122. Second projection 62 may also include locking groove 66.

Figure 2:
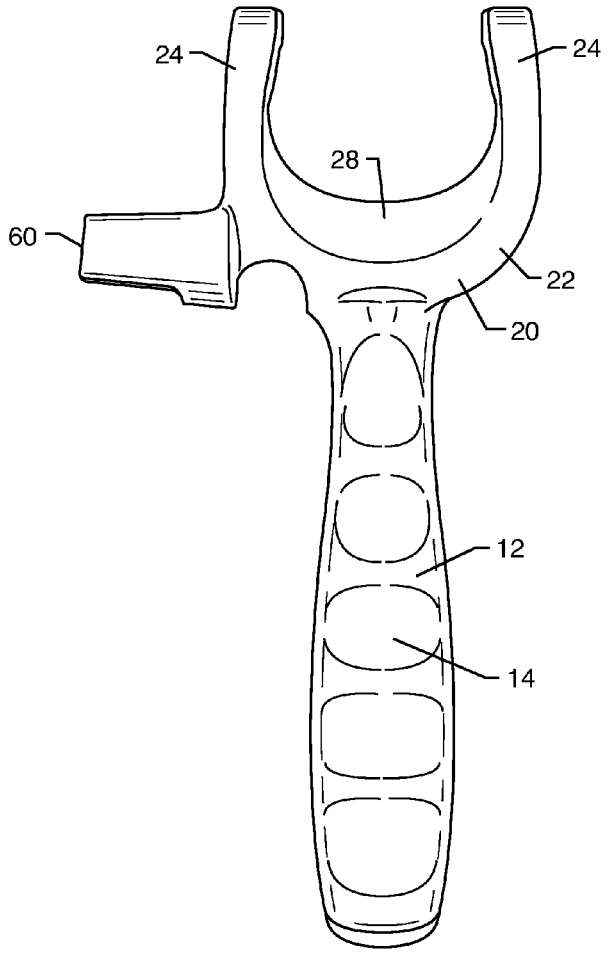
FIG. 2 illustrates a front elevational view of an exemplary tool according to the present invention.
Figure 3:
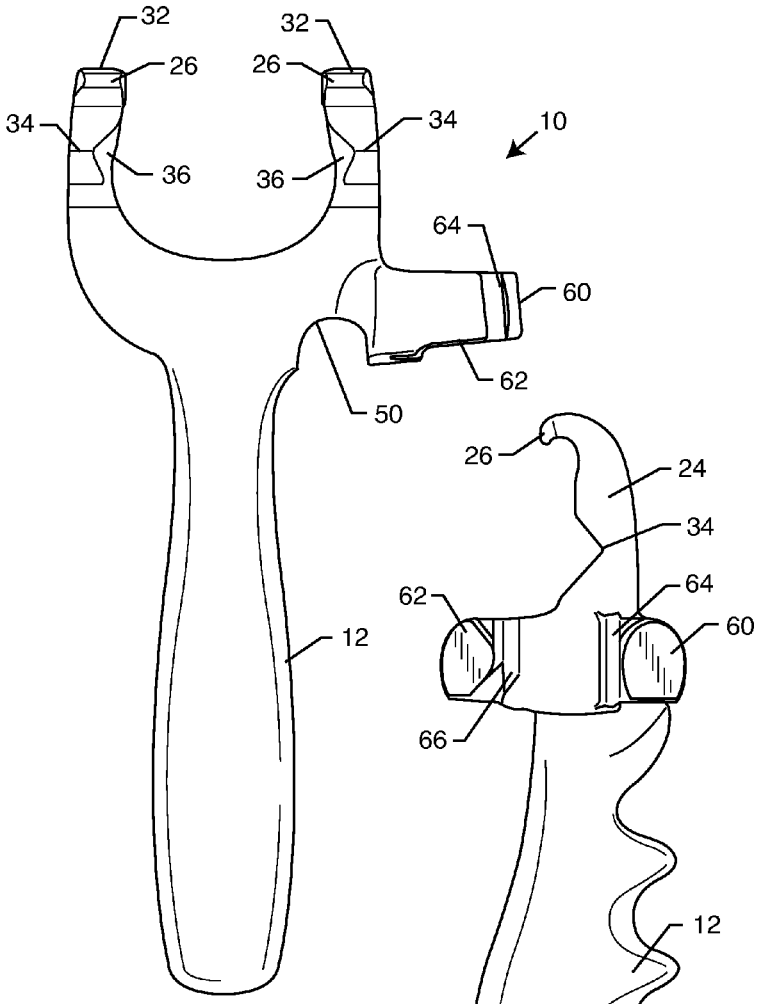
FIG. 3 illustrates a rear elevational view of an exemplary tool according to the present invention.
Figure 4:
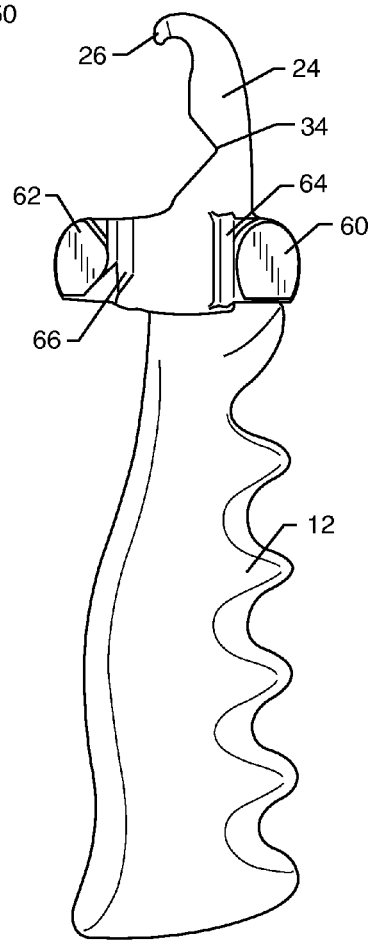
FIG. 4 illustrates a left side elevational view of an exemplary tool according to the present invention.
Figure 5:
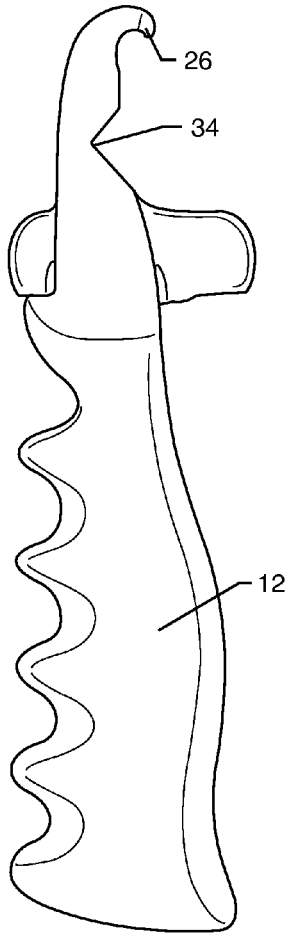
FIG. 5 illustrates a right side elevational view of an exemplary tool according to the present invention.
Figure 9:
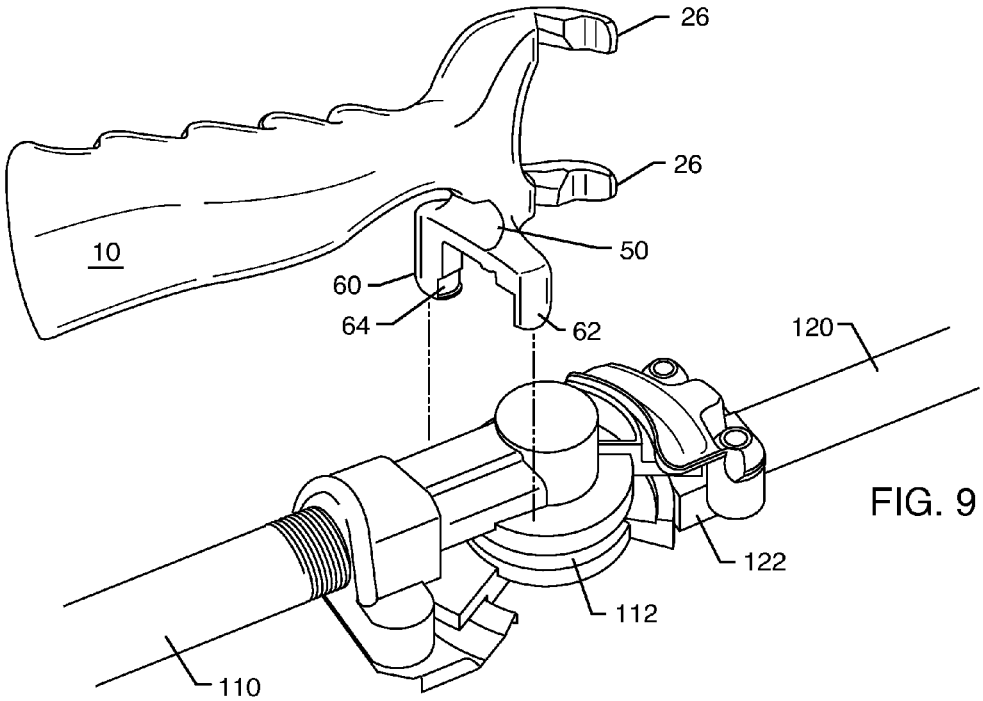
FIGS. 9-14 illustrate how an exemplary tool according to the present invention may be used to start separate an air connection between a truck cab and a trailer.
Figure 10:
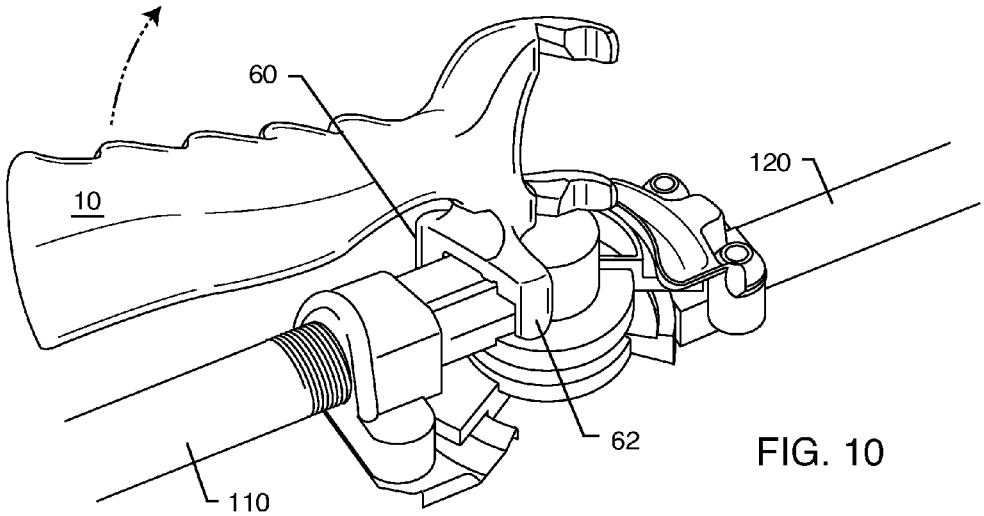
Figure 11:
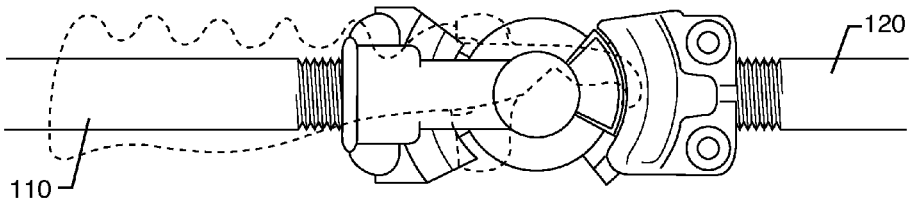
Figure 12:
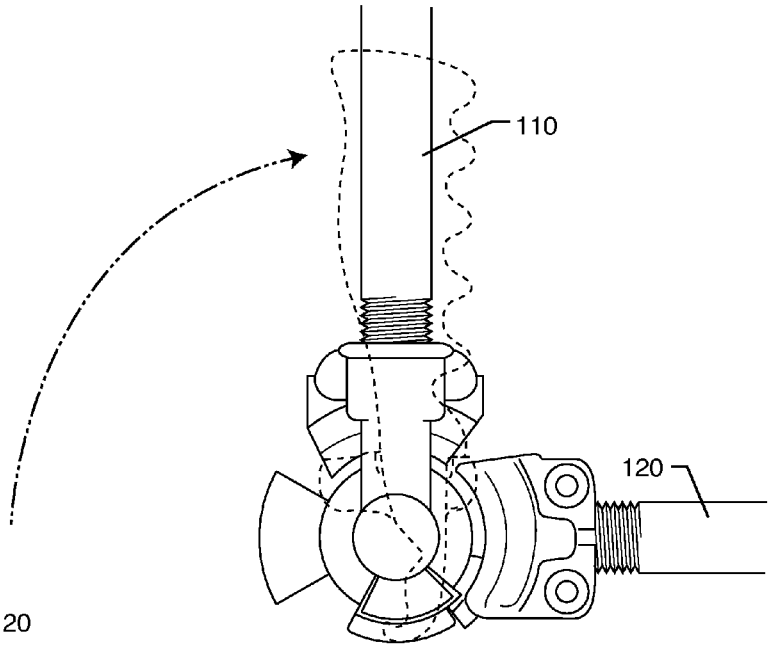
Figure 13:
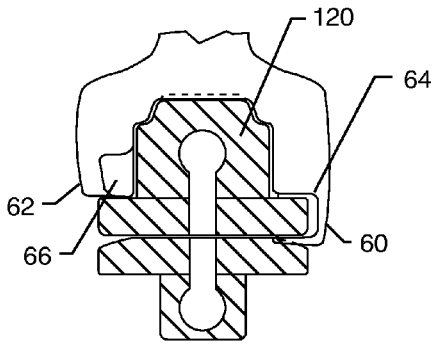
Figure 14:
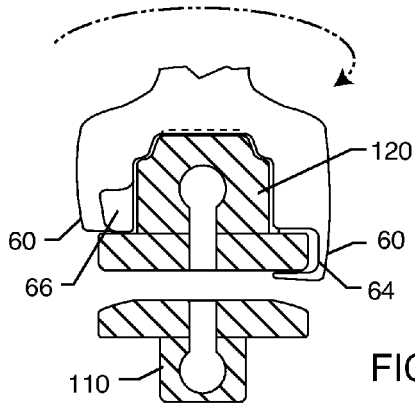

FIGS. 2, 3 and 9 illustrate another feature of a tool according to the present invention. Kingpin pulling slot 50 allows the user to engage and pull on a kingpin located on the underside of a trailer and thus facilitate separation of a trailer from a truck cab.

The foregoing description of an exemplary embodiment of the present invention has been presented for purposes of enablement, illustration, and description. It is not intended to be exhaustive of or to limit the present invention to the precise form discussed. There are, however, other configurations for motor vehicle utility tools not specifically described herein, but with which the present invention is applicable. The present invention should therefore not be seen as limited to the particular embodiment described herein; rather, it should be understood that the present invention has wide applicability with respect to motor vehicle utility tools. Such other configurations can be achieved by those skilled in the art in view of the description herein. Accordingly, the scope of the invention is defined by the following claims.

What is claimed is:

1. A tool comprising:

a handle;

a generally U-shaped forked member attached to said handle, wherein said forked member comprises:

a curved element;

a pair of linear elements each having a proximal end and a distal end, said linear elements attached to said curved element at their respective distal ends extending away from said handle; and a hook extending from the distal end of each of said linear elements, each said hook positioned so as to be parallel to each other;

an interface portion disposed on said forked member;

a gripping portion on said handle; and a gripping grove disposed in each of said linear elements.

2. The tool according to claim 1, wherein each said gripping groove further comprises a sloped portion.

3. The tool according to claim 1, further comprising a first projection and a second projection extending from one of said linear elements.

4. The tool according to claim 1, wherein each of said gripping grooves further comprises a sloped portion.

5. The tool according to claim 4, wherein said projections extend substantially perpendicular to the linear element.

6. The tool according to claim 4, wherein said projections are tapered.

7. The tool according to claim 4, wherein said first projection is longer than said second projection.

8. The tool according to claim 7, wherein said second projection further comprises a locking groove.

9. The tool according to claim 4, wherein said first projection further comprises a locking groove.

* * * * *